United States Patent [19]

Lonati

[11] 4,231,235

[45] Nov. 4, 1980

[54] DEVICE FOR ADVANCING THE MAIN DRUM IN A CIRCULAR KNITTING MACHINE

[76] Inventor: Francesco Lonati, Via Valsorda, 28, Brescia, Italy

[21] Appl. No.: 28,154

[22] Filed: Apr. 9, 1979

[30] Foreign Application Priority Data

Apr. 14, 1978 [IT] Italy ..... 22355 A/78

[51] Int. Cl.[3] ..... D04B 15/00

[52] U.S. Cl. ..... 66/236; 66/237

[58] Field of Search ..... 66/231, 233, 236, 237, 66/234, 235

[56] References Cited

U.S. PATENT DOCUMENTS

| | | | |
|---|---|---|---|
| 1,065,487 | 6/1913 | Wildman et al. | 66/237 |
| 4,072,029 | 2/1978 | Harlow et al. | 66/231 |

FOREIGN PATENT DOCUMENTS

| | | | |
|---|---|---|---|
| 1162024 | 1/1964 | Fed. Rep. of Germany | 66/234 |
| 2739384 | 5/1978 | Fed. Rep. of Germany | 66/237 |
| 658538 | 12/1963 | Italy | 66/234 |
| 909716 | 3/1972 | Italy | 66/236 |
| 350887 | 10/1972 | U.S.S.R. | 66/237 |

*Primary Examiner*—Wm. Carter Reynolds

*Attorney, Agent, or Firm*—Guido Modiano; Albert Josif

[57] ABSTRACT

For advancing the main drum in a circular knitting machine there is provided a device comprising a ratchet wheel rigid with the drum and having five rows of teeth axially spaced thereon. Five pawls are movable back and forth for engagement with the teeth of a respective row. A primary pawl can be disengaged from the ratchet wheel under control of the main chain, and four secondary pawls reciprocate in regular succession so as to perform two back and forth movements in the span of two revolutions of the needle cylinder(s). The secondary pawls have a front end wider than the axial width of the teeth. Between the rows of teeth there are arcuate members having a circumferential length depending on the knitting program and a height such as to disengage the pawls from the respective teeth. The arcuate members may be easily replaced to provide further advancing sequences for the main drum.

4 Claims, 8 Drawing Figures

DEVICE FOR ADVANCING THE MAIN DRUM IN A CIRCULAR KNITTING MACHINE

BACKGROUND OF THE INVENTION

This invention relates to a device for advancing the main drum in a circular hose or the like knitting machine.

As is known, the main drum of such machines is provided with a plurality of lugs or juts arranged on its peripheral surface in conformity with the machine knitting program, and must be advanced stepwise or continuously over short distances, in order for it to actuate the various operational components of the machine as required. For the advance movement, a ratchet and pawl mechanism is utilized which comprises at least one pawl adapted for engaging a sawtooth ratchet wheel rigid with the drum itself, the pawl being moved back and forth in synchronism with the needle cylinder(s).

A device of this type is disclosed in Italian Pat. No. 909,716 granted to Francesco Lonati. Three pawls are provided in that device: namely, a primary pawl operationally associated with the programming chain of the machine to advance the drum by one step at predetermined times; and two secondary pawls which can be moved alternately back and forth to further advance the drum through more steps, if necessary. Both the primary pawl and secondary ones are disengageable from the teeth of the ratchet wheel, the former by raising upon control by the chain, and the latter by means of a raising movement set up by pins arranged at the wheel sides in accordance with a preset program. Thus, it becomes possible to not only advance the drum through one or more steps at a time, but also to do so continuously. The possibility of disengaging the pawls as desired affords a reduction in the number of drum advancing steps while knitting, and accordingly of the drum dimensions.

The movement of the pawls is continuous, even while raised, because it is derived through levers controlled by the profiles of respective disk cams which rotate in synchronism with the needle cylinder(s). The cams are configurated and rotated such that the primary pawl is reciprocated back and forth once every two revolutions of the needle cylinder, and each secondary pawl performs four such back and forth movements, distributed over two revolutions of the cylinder(s), the oscillations of the latter being mutually alternated.

That device has proved itself to be particularly advantageous, owing both to the rationalization of the drum movements and to its simple design and quick possibility of adjustment to suit a variety of knitting programs. By providing a primary pawl which is controlled directly by the machine main chain, the drum is ensured to always start in timed relationship with the cylinder(s), i.e. with the same reference generatrix of the cylinders.

SUMMARY OF THE INVENTION

This invention sets out to further improve on a device of the type described above, thereby to provide an improved rationalization of the main drum advance movements, and accordingly smaller dimensions for the drum itself, a quicker and simpler adjustment procedure, reduced noise emission, and a structure which ensures eveness of advance even after prolonged operation.

It is a further object of the invention to provide a device as above, which can be adapted for a variety of knitting programs through very simple and quick operations.

These and other objects, such as will become more clearly apparent hereinafter, are achieved by a device for advancing the main drum in a circular hose or the like knitting machine, wherein a sawtooth ratchet wheel is rigid with the main drum and caused to advance by pawls which are movable back and forth in synchronism with the needle cylinder(s) of the machine, said pawls comprising a primary pawl operatively associated with the machine programming chain and alternately movable secondary pawls controlled to only advance said ratchet wheel at preset times, the device being characterized in that four secondary pawls are provided, said four secondary pawls being movable in regular succession such that each thereof performs two back and forth movements within the span of two revolutions of the needle cylinder(s), that said ratchet wheel has axially spaced apart rows of teeth equal in number to said pawls, that between adjacent ones of said rows of teeth there are arranged programming members, said programming members extending circumferentially over a distance related to the machine knitting program and radially at least as far as the tips of the teeth of said ratchet wheel, and that said pawls are each provided with a working end having a greater width dimension than the axial dimension of said teeth.

A device so constructed, wherein the secondary pawls are disengaged from the sawtooth ratchet wheel by means of programming members located between the ratchet wheel rows of teeth, affords the possibility of eliminating a higher number of drum advance movements because one is enabled to select the desired advance movement from a higher number of pawl movements, or in other words neutralize a higher number of strokes of the pawls before the primary pawl produces a positive advance movement of the drum. It follows that the drum can have a smaller diametrical dimension, i.e. that for a given machine output the drum can be made smaller.

By providing a greater number of pawls, the disk cam profiles controlling their movements can be made smoother, thus making the device itself less noisy and the regularity of the advance movement more reliable, inasmuch as each pawl dwells at the end position of the advance movement for a longer time and is only brought back after the other pawl has positively advanced to the stroke end position. The pawls themselves and the members associated therewith, such as the return springs, are less stressed and ensure therefore a higher durability for the device, even at higher speeds. The cam wear is also reduced, by virtue of their more regular or smoother profile. By arranging the programming members between the rows of teeth of the sawtooth ratchet wheel, the sequence of the drum advance movements can be changed rapidly, since such members, which are attached to the wheel, e.g. by means of screws, can be easily and quickly replaced with others having different lengths.

The arrangement comprising four pawls operated in succession is known from German Pat. No. 1,162,024. In that case, however, the teeth in each row are spaced apart irregularly, in conformity with the machine advance program. Therefore, several different disks must be provided and secured at appropriate angular positions with respect to one another and to the drum. This involves considerable problems of adjustment. Furthermore, no primary pawl is provided to ensure that the drum always starts in timed relationship with the needle cylinder(s), and any accidental phase displacement of the cylinder(s) results in a succession of erroneous controls, which reflects in the product having to be discarded.

The same problem may be encountered with the device described in U.S. Pat. No. 4,072,029, wherein five pawls are provided for operating in succession, but no independent primary pawl. That device, moreover, provides for simultaneous operation and simultaneous exclusion of all the pawls every two revolutions of the cylinder, thereby further controls are required which make the structure a complicated and difficult one to adjust. In fact, in addition to the control derived from the main chain, an exclusion control must be provided which is derived directly from the drum or the wheel rigid therewith. Furthermore, no spaced apart rows of teeth are provided, but rather continuous teeth in the axial direction, between the teeth there intervening shaped plates contoured to disengage the pawls, when necessary, from the teeth, and formed with openings adapted for permitting the pawls to engage the teeth whenever this is required by the advance program. The arrangement of such plates involves the provision of bands or springs all around the ratchet wheel to retain the plates in place, which makes adaptation to other advance programs an even more difficult task.

BRIEF DESCRIPTION OF THE DRAWINGS

Further features and advantages of the invention will become more clearly apparent from the following description of a preferred, but not limitative, embodiment of the invention, given herein by way of example only and illustrated in the accompanying drawings, where.

DESCRIPTION OF THE PREFERRED EMBODIMENTS

Figure 2:
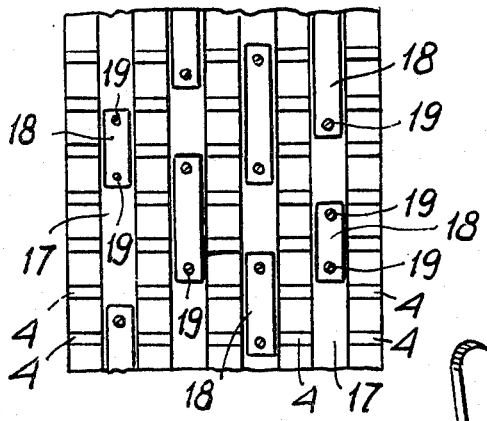
FIG. 2 is a partial view from above of the sawtooth ratchet wheel in a device according to the invention.
Figure 3:
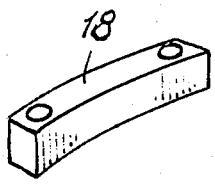
FIG. 3 shows in perspective a programming member.

In the drawing figures, the various ratchet wheels are represented as only partially toothed, for simplicity, but it will be understood that the teeth extend all along the circumference of the wheels themselves.

Figure 1:
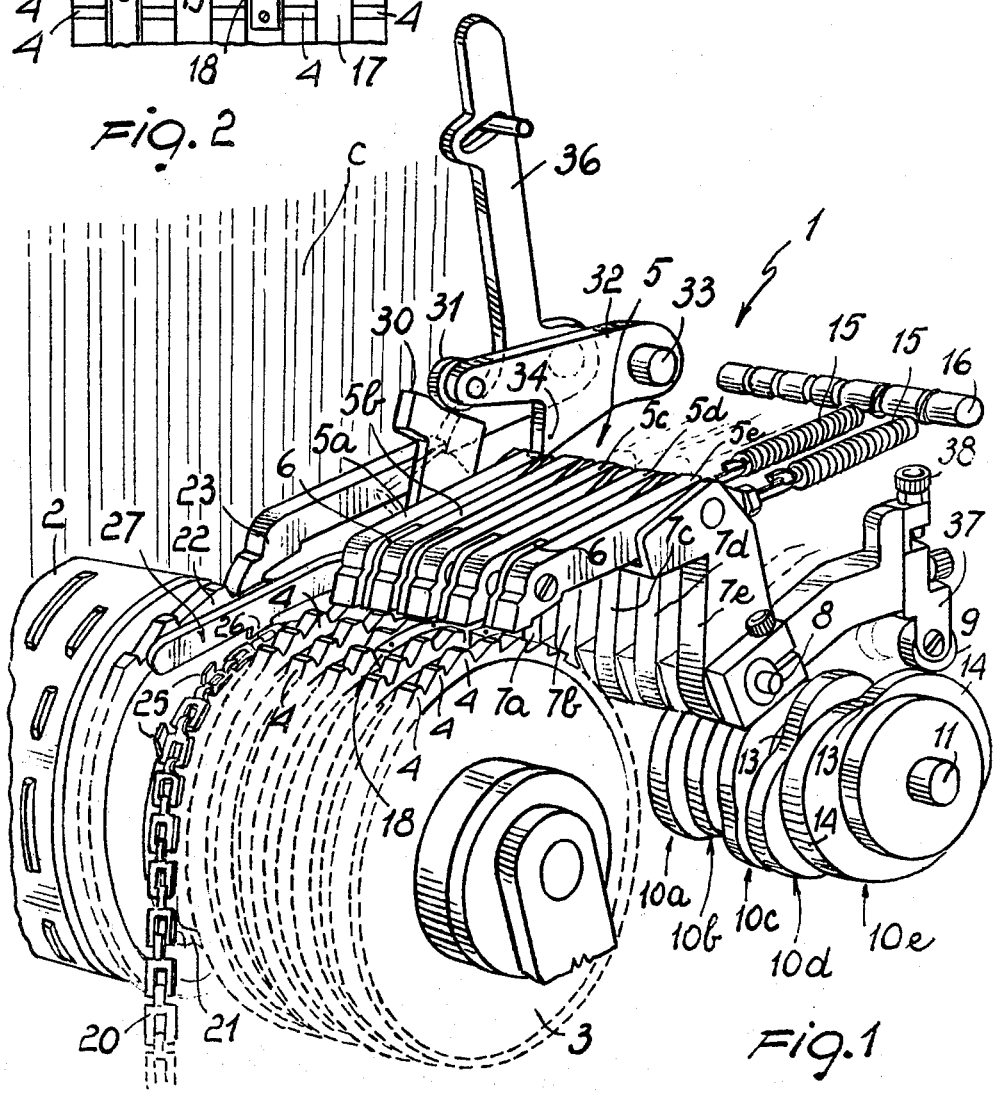
FIG. 1 is a perspective view of the essential components of a device according to the invention, some of these components being only shown in part for clarity of illustration.

With reference first to FIG. 1, the device 1 for advancing the main drum 2 of a circular hose or the like knitting machine, according to this invention, comprises a ratchet wheel 3 rigid with the main drum 2 along the same axis as the drum and provided with teeth 4 of substantially trapezoidal or sawtooth shape. The teeth 4 are distributed along parallel and axially spaced apart rows, such rows being equal in number to the pawls 5 intended for advancing the wheel 3. The pawls 5 comprise a main pawl 5*a* and four secondary pawls 5*b*, 5*c*, 5*d* and 5*e*, preferably identical in shape.

The front working end of the secondary pawls 5*b*–5*e* has a greater width than the axial width of the teeth 4 of the wheel 3, said greater width being preferably achieved by affixing to the side of each secondary pawl a small plate 6. The plate 6 has a profile corresponding to the shaped profile of each of the secondary pawls 5*b*–5*e* (FIG. 1). The opposite end of the secondary pawls, as well as that of the primary pawl 5*a*, is journalled to one end of a respective crank lever 7*a*–7*e* along an axis parallel to the axis of the drum 2, each lever 7*a*–7*e* being freely journalled to a common supporting shaft 8 attached to the machine frame parallel to the axis of the drum 2. The other end of each lever 7*a*–7*e* is intended to follow, through the interposition of a respective roller 9, a corresponding cam 10*a*–10*e*.

Figure 5:
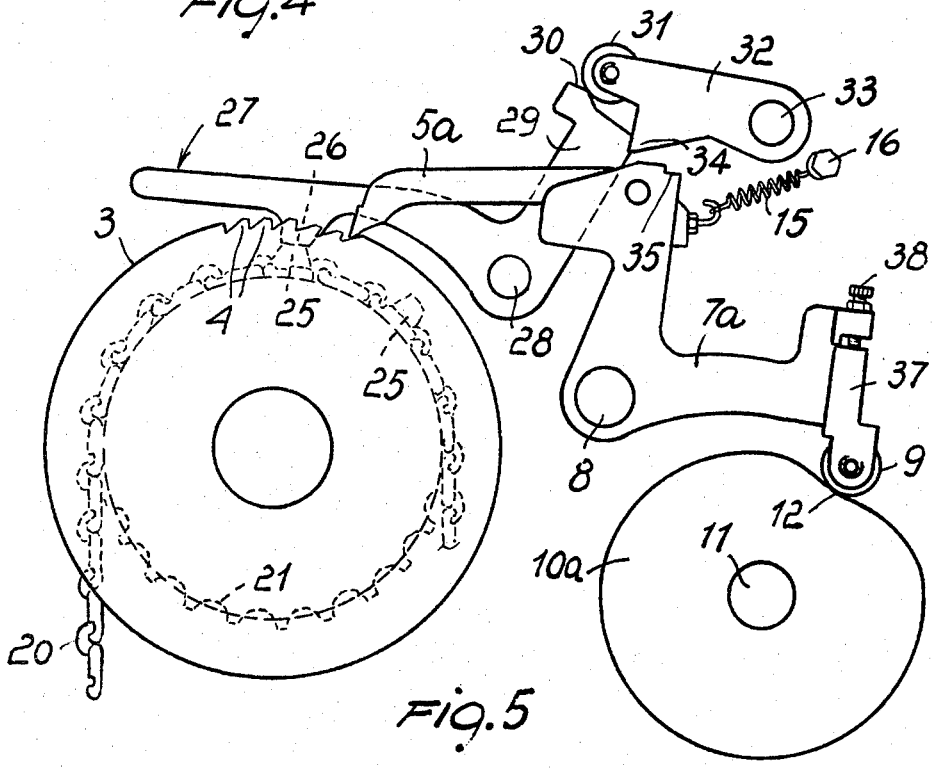
Figure 6:
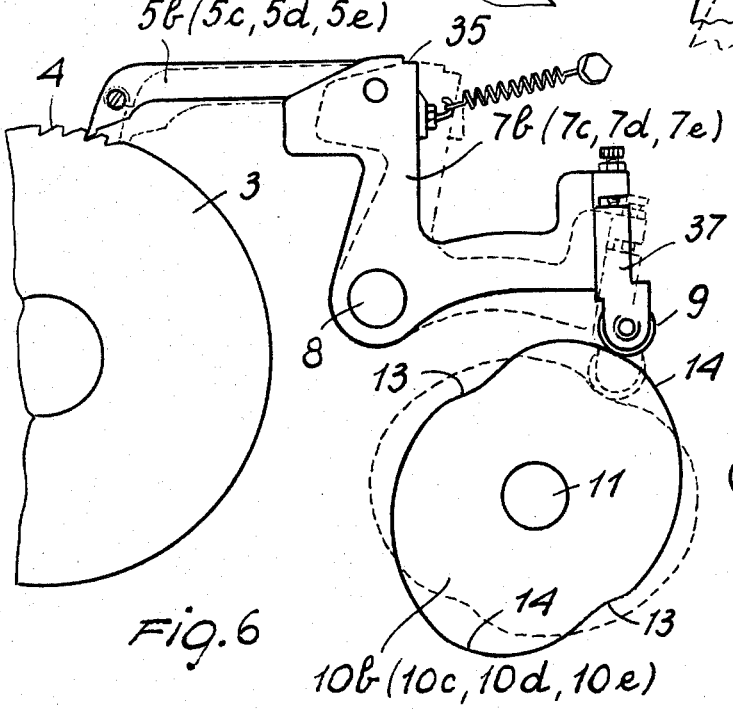

The cams 10*a*–10*e* are secured to a common shaft 11, extending parallel to the drum axis and being driven rotatively by the machine motor means at a rotation speed such that it completes one revolution for every two revolutions of the needle cylinder(s). The cam 10*a*, intended for actuating the primary pawl 5*a*, has a depression 12, shown in FIGS. 4 and 5, while the cams 10*b*–10*e*, intended for actuating the secondary pawls 5*b*–5*e*, each have, as shown in FIG. 6, two diametrically opposed depressions 13, or in other words two bulging portions 14 located diametrically opposite each other between the depressions 13, and are arranged so as to be angularly shifted from one another by an angle of 45° on the shaft 11. The depth of the depressions 12,13 is such as to produce, during the rotation of the cams 10*a*–10*e*, a reciprocating or back and forth movement of the pawls 5*a*–5*e* resulting in a one tooth advance movement of the ratchet wheel 3 for each depression of the cams 10*a*–10*e*. The contact between the rollers 9 and cams 10*a*–10*e* is ensured by springs 15 stretched between the pivoted ends of the pawls 5*a*–5*e* and a stationary rod 16.

According to the invention, the spaces 17 between the rows of teeth 4 of the ratchet wheel 3 are occupied by programming members 18, comprising of preference elongate arcuate blocks which are removably attached to the periphery of the wheel 3, e.g. by means of screws 19. The circumferential length of the blocks 18 is a function of the advancing program for the drum 2 of the machine, as will be explained hereinafter; the radial height of the blocks 18 is such as to reach or even slightly overtop the tips of the teeth 4 of the wheel 3.

The primary pawl 5*a* is operatively associated with, and can be inactivated by, the main programming chain 20 of the machine, the chain being passed around a sprocket wheel 21, which in the example shown is coaxial to the main drum 2 but idly mounted with respect thereto. Rigid with the sprocket wheel 21 is a chain driving ratchet wheel 22, driven for stepwise rotation by a pawl 23 controlled by a cam 24 in a manner known per se. The pitch of the teeth of the ratchet wheel 22 is twice that of the teeth 4 of the wheel 3, and the advance movement corresponds to one tooth every two revolutions of the needle cylinder C. Advantageously, the pawl 23 may be identical to the pawls 5*a*–5*e*, and may be controlled through identical means, with the exception of a different profile for the respective cams.

Some links of the chain 20 carry, arranged in conformity with the machine knitting program, juts 25 adapted for acting on a vertical lug 26 of a crank-like control lever 27 which is journalled to the machine at 28, along an axis parallel to the axis of the drum 2. The lever 27 has an arm 29 provided with a contoured end 30, wherewith cooperates a roller 31 carried idle by one end of a small stop lever 32 which is freely journalled, at its other end, to a pin 33 rigid with the frame of the machine and parallel with the axis of the drum 2. The lever 32 is located in the plane of the primary pawl 5*a* and is provided with a frontally located tooth 34 operative to interfere with a notch 35 of the pawl 5*a* or lever 7*a*. The contoured end 30 of the arm 29 has two portions which are at different distances from the pivot axis of the lever 27 and so arranged as to cause, when the lever 27 occupies a position whereat the lug 26 engages no juts 25 (FIG. 4), the roller 31 to engage with the portion closest to to the axis of the lever 27 and the lever 32 to engage with the primary pawl 5*a*, thus preventing any movements thereof, whereas when the lever 27 occupies a position whereat the lug 26 is raised by a jut 25 (FIG. 5), the roller 31 engages with the other portion of the contoured end 30 and the lever 32 is disengaged from the primary pawl 5*a*, to permit the movements of the latter.

Advantageously, the pawl 23 can also be locked in the end of advance travel position by means of a manually operated lever 36.

The operation of the device described hereinabove is the following.

In their rest or inoperative condition, the pawls 23 and 5*a* are locked by the levers 36 and 31 respectively in the end of advance travel positions, thereby the respective cam following rollers 9 do not follow the profile of the respective cams 24 and 10*a*, but are raised therefrom at the depressions of the cams themselves. The primary pawl 5*a* is at the position shown in FIG. 4, and the drum 2 is stationary.

Figure 8:
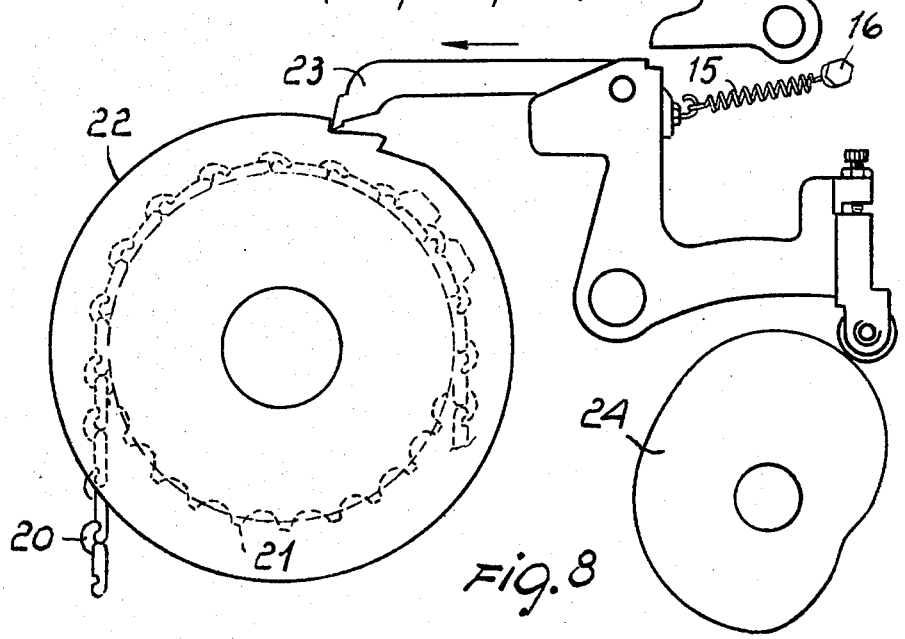
FIG. 8 shows a ratchet gear and related control members for advancing the machine main programming chain.

In the operating conditions, the chain 20 is moved in a conventional manner, and advances through one link every two revolutions of the needle cylinder(s) under the effect of the released pawl 23 (FIG. 8); the primary pawl 5*a*, however, remains locked (thereby the drum 2 is stationary) until a jut 25 on the chain 20 raises the crank lever 27, and consequently the lever 32 (FIG. 5) as well. The primary pawl 5*a* is thus subjected by the cam 10*a* to a back and forth movement thereby the wheel 3 and drum 2 are advanced through one step. It should be noted that this main or primary advance movement is always performed in timed relationship with the needle cylinder, by virtue of the advance movement of the chain 20 being synchronized with the rotation of the needle cylinder, such that the advance of the primary pawl 5*a* and accordingly of the drum 2 always occurs with the needle cylinder in the same angular position.

Upon completion of the one step advance movement, owing to the configuration of the associated cam 10*a*, the primary pawl 5*a* no longer moves until the two cylinder revolutions that brought into operation the pawl have been completed.

Figure 7:
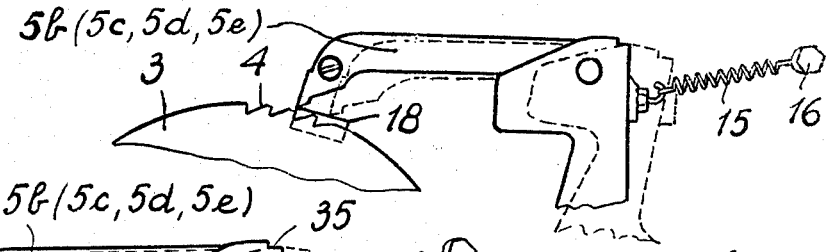
FIGS. 6 and 7 show one of the secondary pawls in two operative positions thereof, namely while imparting a positive advance movement to the drum (FIG. 6), and while idling (FIG. 7)

However, during those two revolutions of the cylinder, the secondary pawls 5*b*–5*e*, for which no locking member is provided, continue to move in succession as controlled by the respective out-of-phase cams 10*b*–10*e*, such that one secondary pawl is advanced during the first quarter revolution of the cylinder, a second pawl during the second quarter revolution, a third pawl during the third quarter, a fourth pawl during the fourth quarter, and forth at every revolution of the cylinder. However, the advancing of each secondary pawl will be effective to advance the main drum 2 only when a programming block 18 happens to be absent. In fact, as shown in FIG. 6, it is only in the absence of the block 18 that the tip of the pawl is enabled to engage a tooth of the ratchet wheel 3 and produce accordingly a one step advance of the wheel 3 and drum 2, whereas when, as shown in FIG. 7, a block 18 is present, the tip of the pawl slides over the block without engaging any of the teeth.

It will be appreciated that a programmed arrangement of blocks 18 on the wheel 3, i.e. an arrangement of blocks 18 having different lengths, allows operation of one secondary pawl rather than another, with the result that one or more further advance movements of the drum 2 additionally to the first produced by the primary pawl 5*a* may be obtained depending on knitting requirements.

Since the first advance movement of the drum is produced directly by the primary pawl, there will be a secondary pawl that cooperates with the primary pawl during this advance movement. In other words, one of the depressions 13 in one of the cams 10*b*–10*e* will be located at an angular position which corresponds to the depression 12 of the main cam 10*a*. The arrangement of the blocks 18 will anyhow be such that the first advance movement at every two revolutions of the cylinder is always produced by the primary pawl 5*a*.

In the extreme, it is possible to neutralize all of the strokes of the secondary pawls, but in that case it will be necessary to await a new advance movement of the primary pawl 5*a*, as determined by a further jut 25 of the chain 20, after two revolutions of the cylinder have been completed.

From the foregoing, it will be apparent how the device according to the invention provides for the drum advance to be always initiated by the primary pawl; thus, even if for a reason whatever the needle cylinder is rotated accidentally, the advancing of the drum 2, then at a standstill, cannot be effected by the secondary pawls prior to the intervention of the primary pawl, which primary pawl will restart the sequence of advance movements exactly in phase with the angular position of the needle cylinder(s).

Compared to the device of Italian Pat. No. 909,716 above, wherein one stroke of a secondary pawl can be omitted at most, and thus eliminate at most four pawl thrusts every two revolutions of the cylinder, the device according to this invention will economize up to seven pawl thrusts every two cylinder revolutions, which affords the possibility of providing a smaller drum for a given knitting program.

Figure 4:
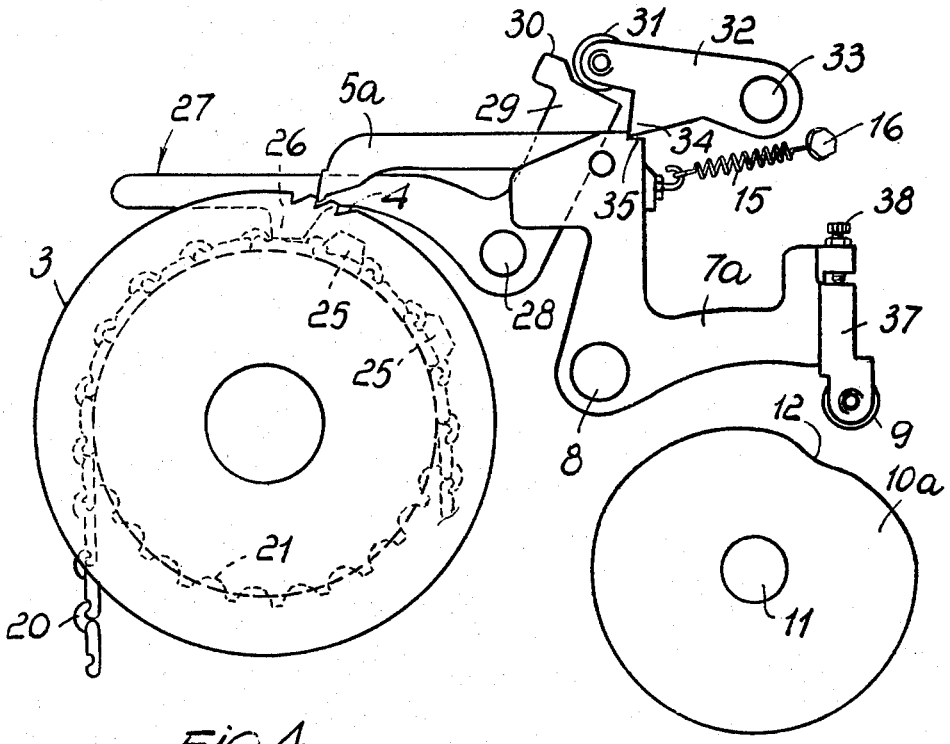
FIGS. 4 and 5 illustrate the primary pawl and the members ensuring its movements, respectively at the inoperative or rest stage and at the operative or working one.

In addition to the advantages mentioned above, the instant device has the advantage that the angular arrangement of the secondary pawl control cams is less critical, thanks to the smoother profile of the cams. Moreover, wear is also reduced because the number of the strokes that each pawl is called upon to complete within the span of two cylinder revolutions is halved. This results in less stress for the springs 15, and improved durability of the same. In any case, in the event that the springs 15 should break, they cause no problem because, as shown in FIGS. 4–6, the crank levers 7*a*–7*e* are so designed as to have their center of gravity located well towards the ends next to the cams 10*a*–10*e*.

Advantageously, the position of the pawls 5*a*–5*e* can be adjusted by placing the cam following roller 9 onto an element 37 the position whereof can be adjusted on its respective crank lever by means of a screw 38, said screw being easily accessible to the machine operator and producing a substantially radial displacement of the roller 9 with respect to the respective cam 10*a*–10*e*.

The provision for locking the primary pawl 5*a* in its rest position, away from the cam 10*a*, advantageously results in less wear of the various components and less noise.

The invention as described is obviously susceptible to many modifications and variations, without departing from the scope of the appended claims. Furthermore, it may be advantageously applied equally well to a single cylinder and to a double cylinder circular knitting machine.

I claim:

1. In a circular knitting machine having at least one needle cylinder, a main drum for controlling knitting steps and a sawtooth ratched wheel rigid with said drum, a device for controlling advancement of said drum, said device comprising a primary pawl and four secondary pawls, a number of rows of teeth on said ratched wheel corresponding to the number of said pawls, said teeth each having a tip and an axial width, means for moving back and forth said primary pawl and said secondary pawls such that said primary pawl performs one back and forth movement during two revolutions of said at least one needle cylinder and said secondary pawls each performs two back and forth movements in regular succession within the span of two revolutions of said at least one needle cylinder, means for inactivating said primary pawl according to a knitting program, programming members arranged between said rows of teeth, said programming members extending circumferentially over a distance related to said knitting program and radially at least as far as said tips of said teeth, each of said secondary pawls having a working end having a width greater than said axial width of said teeth.

2. A device according to claim 1, wherein said programming members each comprises elongate arcuate blocks removably secured to said sawtooth ratched wheel.

3. A device according to claim 1, wherein each of said secondary pawls has a shaped profile and further has a plate at one side for contacting said programming members, said plate having a profile corresponding to said shaped profile.

4. A device according to claim 1, wherein said means for inactivating said primary pawl comprise a main chain, a notch in said pawl at one end thereof opposite to said working end, a stop lever pivotally supported above said pawl and having a tooth adapted for penetrating said notch, a roller at one end of said stop lever, a control lever operated by said main chain, said control lever having a contoured end engaged by said roller and said main chain having juts thereon spaced apart in accordance with said knitting program to move said control lever between a position in which said contoured end holds said stop lever in a position in which said tooth penetrates said notch to lock said primary pawl and a position in which said contoured end holds said stop lever disengaged from said primary pawl.

* * * * *